US005881681A

United States Patent [19]

Stuart

[11] Patent Number: 5,881,681

[45] Date of Patent: Mar. 16, 1999

[54] WATER HEATING SYSTEM

[75] Inventor: Kevin J. Stuart, Highland Mills, N.Y.

[73] Assignee: Aerco International, Inc., Northvale, N.J.

[21] Appl. No.: 787,823

[22] Filed: Jan. 23, 1997

[51] Int. Cl.[6] ..... F22B 5/00

[52] U.S. Cl. ..... 122/16; 122/367.1; 122/448.1; 236/18

[58] Field of Search ..... 122/367.1, 367.2, 122/367.3, 16, 448.1; 236/18

[56] References Cited

U.S. PATENT DOCUMENTS 4,271,789 6/1981 Black ..... 122/16
4,852,524 8/1989 Cohen ..... 122/448 R

*Primary Examiner*—Ronald Capossela
*Attorney, Agent, or Firm*—Baker & Botts, L.L.P.

[57] ABSTRACT

A water heating device comprising (a) combustion means for igniting a combustible mixture of air and gas for heating water; (b) heat exchanger means for providing heat transfer between the hot gases and the water, the exchanger means including a combustion chamber for receiving the hot gases, a water chamber having an inlet and outlet between which water passes, the water chamber enclosing the combustion chamber, and a plurality of exchange tubes connected to the bottom of the combustion chamber, the tubes extending below the combustion chamber and through the water chamber, such that the hot gases flow through the combustion chamber and then through the tubes in physical isolation from and in heat exchange relation with the water, and the water flows about the tubes and then around the outside of the combustion chamber in counterflow to the hot gases; and (c) temperature control means for controlling the temperature of the water, including thermal measuring means having a sensor for sensing the temperature of outgoing portions of the water, and controlling means responsive to the sensed temperature for controlling the rate of heat transfer between the fluids by modulating the flow of air and gas to the combustion means.

25 Claims, 11 Drawing Sheets

WATER HEATING SYSTEM

BACKGROUND OF THE INVENTION

This invention relates to a water heating system and, more specifically, to a water heating system that operates over a broad modulation range with excellent stability, reliability, and cost-efficiency.

Hot water temperature control devices have conventionally included heat exchangers to accomplish heat transfer between water which rapidly flows within tubes and a heat source, either steam or gas, exposed to the outside of the tubes. These systems, generally termed "instantaneous", produce fluctuating temperatures as a result of fluctuating flow and input energy. For example, if the system has an increased change in flow (increase demand for hot water), the temperature of the water will start to decay immediately since the temperature droop is a function of the rate of change of load (flow). In fact, if the load changed instantaneously from 0 to 100% (or to maximum) the outlet water temperature could momentarily drop to close to the inlet water temperature.

Because of the delay (time to increase energy as a result of increased flow and time for water to absorb energy), there is a limit to the gain (amount of energy input per unit of temperature change), which causes droop in the system. For instance, if a device is set for 140° temperature output at low flow, there typically could be a 20°–25° droop under steady state conditions, meaning for a 100% flow there would be a drop in the output temperature of 20°–25°. The temperature errors resulting from poor dynamic response are superimposed on the steady state temperature error that results from the low gains necessary for system stability.

As a result of such poor temperature control, storage tanks are usually employed for use with the instantaneous system to store heated water at a fixed temperature; in one embodiment water is pumped at a constant rate through the system to keep the temperature constant. Other methods include heating the stored water without pumping means and relying on natural convection to accomplish temperature control. Because the use of the storage tank does not by itself solve the problem of temperature control, devices, such as described in U.S. Pat. No. 4,305,547 (the "'547 patent") have been established to improve temperature control. In the '547 patent, the inventor provided an improvement over thermostat and plumbing control devices, a system wherein a combined set point and feed forward control is established that minimizes fluctuations in the temperature of the hot water by anticipating changes in BTU requirements. Such a system is based on an indirect (liquid or steam) method of supplying the energy source to the heat exchanger. In contrast, the tenuous nature of the energy input in a direct fired format such as utilized herein makes temperature control significantly more difficult and requires an even greater degree of sophistication than that described in the '547 patent.

Another problem of prior art systems, whether condensing or noncondensing, relates to total system efficiency, i.e. unit efficiency and distribution system efficiency. These efficiencies affect significantly the cost of fuel per delivered gallon of water. Typically, efficiencies are based upon laboratory conditions at rated (or maximum) load—a continuous operation of rated load. However, in the commercial application for potable water, the load diversity (meaning the load profile) is anything but continuous or constant, i.e., it fluctuates greatly over a period of time. For instance, the loads are higher in the mornings because of concentrated water use whereas in the afternoon the loads are lower since less people require water. Because all systems supply only the energy used, the heating (the input energy) must cycle on and off to supply the reduced load in the afternoon or, as the case may be, the increased load in the mornings. Normally, as load decreases, the unit (heat) cycles on and off to meet load; total energy supplied is sought to equal the reduced energy utilized. It is understood in the art that such cycling reduces efficiency.

Also, as a result of the characteristics of some prior art devices, particularly non-condensing systems, aside from the drawbacks of utilizing a storage tank and distribution and recirculation pumping, system efficiency is inadequate. Poor temperature characteristics and general unawareness of the instantaneous temperature in the distribution systems requires that the temperature be maintained significantly higher than necessary to prevent decay to unacceptable levels of temperature under load. The difference between this distribution temperature and the required use temperature produces continuous energy losses throughout the distribution system. These losses and increased probabilities of scalding are a consequence of existing technology.

Other problems of present devices relate to efficiency performance. For instance, the energy not absorbed by the fluid and not extracted by the flue are lost to the ambient air because the gases are in heat exchange relation not only with the fluid but also the ambient air. In addition, most gas-fired systems attempt to increase the surface area of the gas side of the tubes (to increase the ability of the gas to transfer its heat) by using fins, which have the characteristic of trapping the flue products causing carbon buildup. The greater the build-up of carbon, the worse the heat transfer becomes. As a result, there is a loss of efficiency and users are left with the laborious task of opening and cleaning the heat exchanger.

These problems have been addressed previously, in U.S. Pat. No. 4,852,524 (the "'524 patent"), also assigned to the present assignee Aerco International, Inc. While the water heating system disclosed in the '524 patent was a substantial improvement over the prior art, the present invention seeks to go even further and provides a water heating system with even greater stability, reliability, and cost-efficiency than the one disclosed in the '524 patent.

SUMMARY OF THE INVENTION

The present invention solves the deficiencies described in the previous section and provides a condensing, fully modulating, forced draft, vertical single-pass, fire-tube water heating system that operates over a broad modulation range with excellent stability, reliability and cost-efficiency.

These objectives and characteristics are achieved, in accordance with the present invention, by providing a novel combination of several components including a combustion means for igniting a combustible mixture of air and gas, a heat exchanger means for providing heat transfer between the ignited gases and water, and a temperature control means for controlling the rate of heat transfer between the ignited gases and the water.

The combustion means preferably comprises a nozzle mix burner (as opposed to a premix burner) capable of mixing the air and gas for a complete high quality combustion over a broad range of flows (typically 15:1), resulting in high combustion efficiency and very low pollutant emissions. Specifically, the burner preferably comprises a gas pipe, which is open at the top and capped at the bottom, a cylindrical air chamber, which encloses the gas pipe and which is defined by a cylindrical outer shell, an annular baffle, which covers the top of the air chamber, an air duct on top of the baffle, and a burner head assembly positioned at the bottom of the air chamber. Gas enters the burner from the open end of the gas pipe and exits from the gas cap, which has at least one port for the exit of gas. Air enters through the air duct, passes through ports in the baffle, proceeds through the air chamber, and exits through ports in the burner head assembly.

Preferably, gas tubes extend radially outward from the gas pipe towards the outer shell above the bottom of the burner head assembly to introduce gas for mixing with air in the burner head assembly. It is also preferred that the burner head assembly and the outer shell form an annular channel, through which air from the air chamber and gas from the radial tubes may pass. Vanes are preferably provided in the annular channel to accelerate mixing. The vanes are positioned in asymmetrical relation with the radial tubes. The asymmetrical relation prevents combustion driven oscillation and other instabilities and causes the gases to burn at a very high velocity, thus reducing burning delay and generally increasing the stability of the system.

The heat exchanger means includes a combustion chamber for receiving the ignited gases, a water chamber enclosing the combustion chamber and having an inlet and an outlet between which water passes, and a plurality of heat exchange tubes connected to the bottom of the combustion chamber and extending down through the water chamber. The ignited gases enter the combustion chamber from the top and flow downwards through the combustion chamber and then through the exchange tubes. At the same time, water enters through the water inlet and flows upwards through the water chamber, passing about the outside of the exchange tubes and the combustion chamber. In this way, the ignited gases flow in counterflow to, in physical isolation from, and in heat exchange relation with the water.

Preferably, a baffle is provided beneath the combustion chamber to divert and distribute the flow of the water around the combustion chamber. In addition, it is preferred that the ignited gases and the water are at different temperatures such that a temperature gradient is established in the water in the direction of its flow and that the ignited gases are cooled in flowing down through the tubes, thus causing the vapor in the ignited gases to condense in the tubes when the dew point of the ignited gases is reached. Such condensation provides further heat transfer and efficiency. Preferably, an exhaust manifold is also provided underneath the exchange tubes to direct the combustion products to an exit port and to collect condensate drainage.

The temperature control means includes a thermal measuring means and a control means. The thermal measuring means has a sensor for sensing the temperature of outgoing portions of the water and the control means responds to the sensed temperature and controls the rate of heat transfer between the fluids by modulating the flow of air and gas to the combustion means.

Preferably, the control means includes derivative means for calculating the rate of temperature change of the water and feedback means for subtracting the temperature of the outgoing portion of the water from a set point predetermined temperature, and summation means for generating a control signal based upon the summation of the values generated by the derivative means and feedback means.

Preferably, the control means also includes an air/fuel valve, which is responsive to the control signal to deliver separate flows of air and gas to the combustion means at a substantially constant air/gas ratio. The air/gas ratio is maintained at a programmed relationship as a function of input gas flow. It is preferred that the air/fuel valve is a rotary valve and that the rotation of the valve is substantially linearly responsive to the control signal.

The air/fuel valve contains a gas orifice plate, which controls the flow of gas. Preferably, the gas orifice plate is a circular plate having multiple slots, each slot having an angular aperture and a radial length that is variable throughout a range of the angular aperture.

The present invention preferably also includes an air/fuel train, which comprises a gas and air inlet, a gas valve for selectively opening and closing the flow of gas, a regulator valve for maintaining the pressure drop of gas constant across the air/fuel valve, and a blower for accelerating the flow of air.

These and other features, aspects, and advantages of the present invention will become better understood with regard to the following detailed description, appended claims, and accompanying drawings.

DETAILED DESCRIPTION

Figure 1:
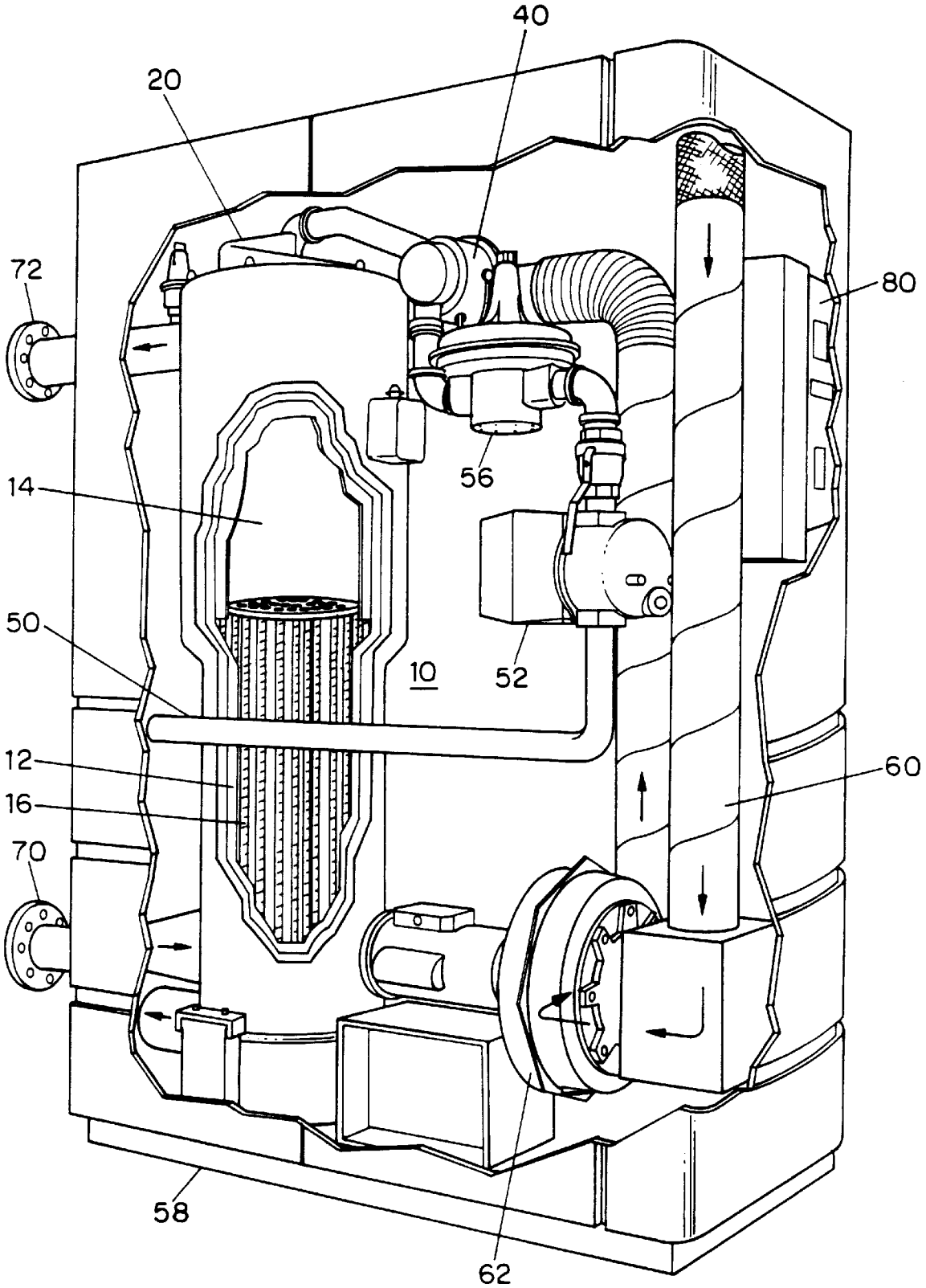
FIG. 1 is a three-dimensional perspective view of an embodiment of the present invention.

Referring to the drawings, and in particular to FIG. 1, a preferred embodiment of the water heating system according to the present invention includes a heat exchanger 10, a burner 20, a temperature controller system 30, an air/fuel valve 40, a gas intake 50, a gas exhaust manifold 58, an air intake 60, a water inlet nozzle 70, a water outlet nozzle 72, and a control panel 80.

The heat exchanger 10 provides for heat transfer between a fluid (preferably a hot gas) and a liquid (preferably water) such that as the water travels upwards within the heat exchanger it increases in temperature establishing a temperature gradient in the direction of flow of water. As shown in FIG. 1, the heat exchanger 10 includes a water chamber 12, a combustion chamber 14, and at least one, but preferably a plurality, of heat exchange tubes 16. The water chamber 12 encloses both the combustion chamber 14 and the heat exchange tubes 16. The combustion chamber 14 is located at the upper end of the water chamber 12. The tubes 16 are connected to the bottom of the combustion chamber 14 and extend downwards through the water chamber 12.

Figure 2:
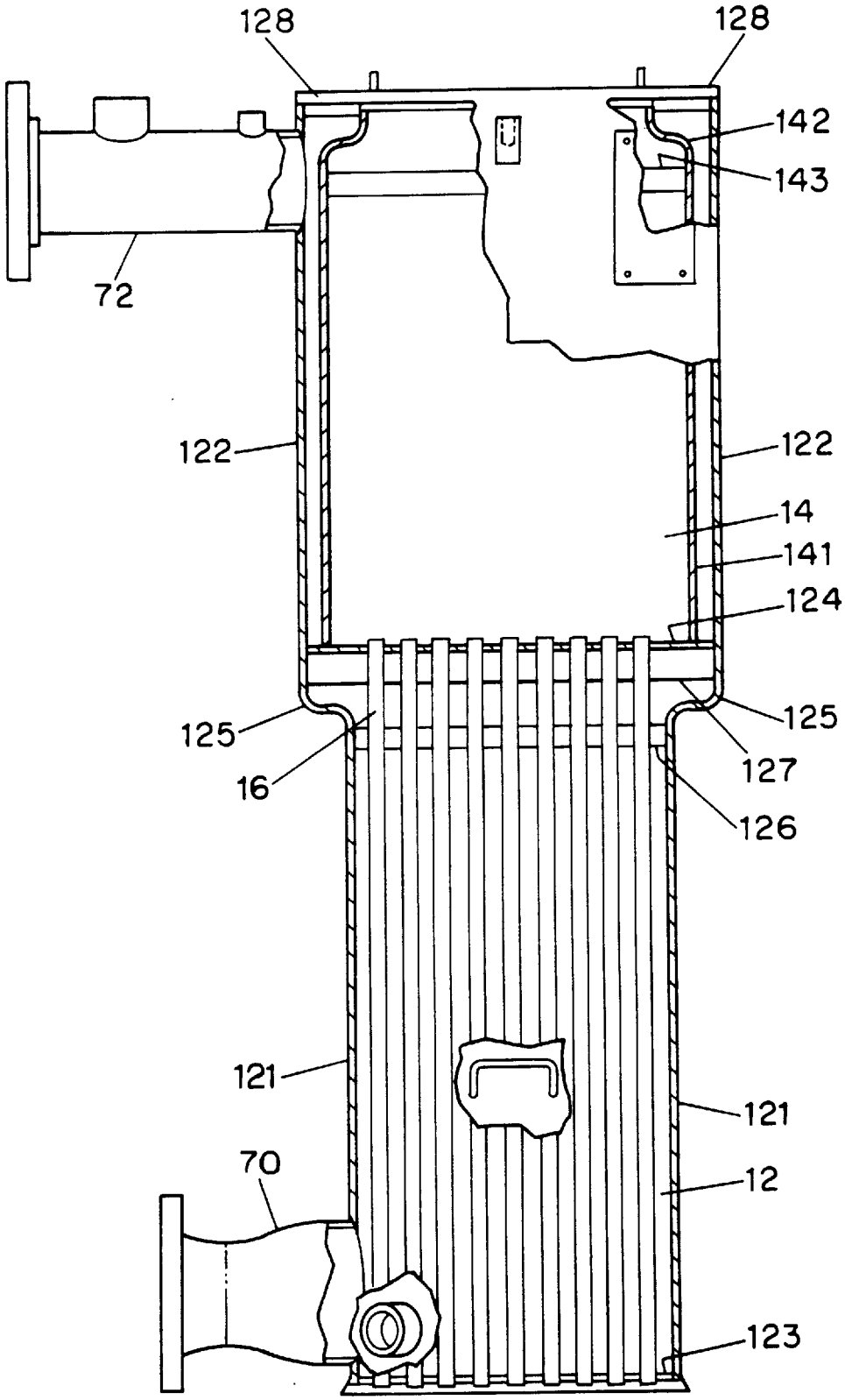
FIG. 2 is a side view of a heat exchanger of an embodiment of the present invention.
Figure 3:
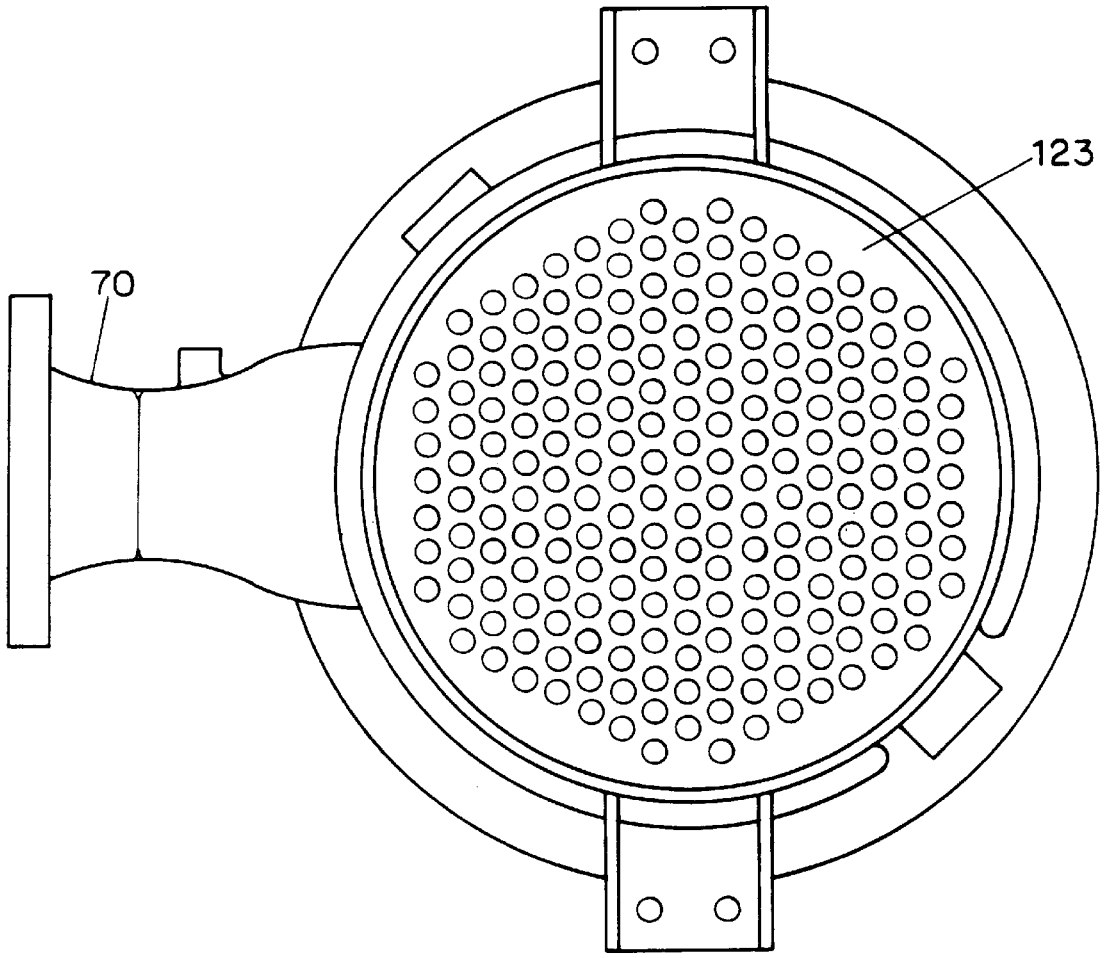
FIG. 3 is a bottom view of the heat exchanger of an embodiment of the present invention.
Figure 4:
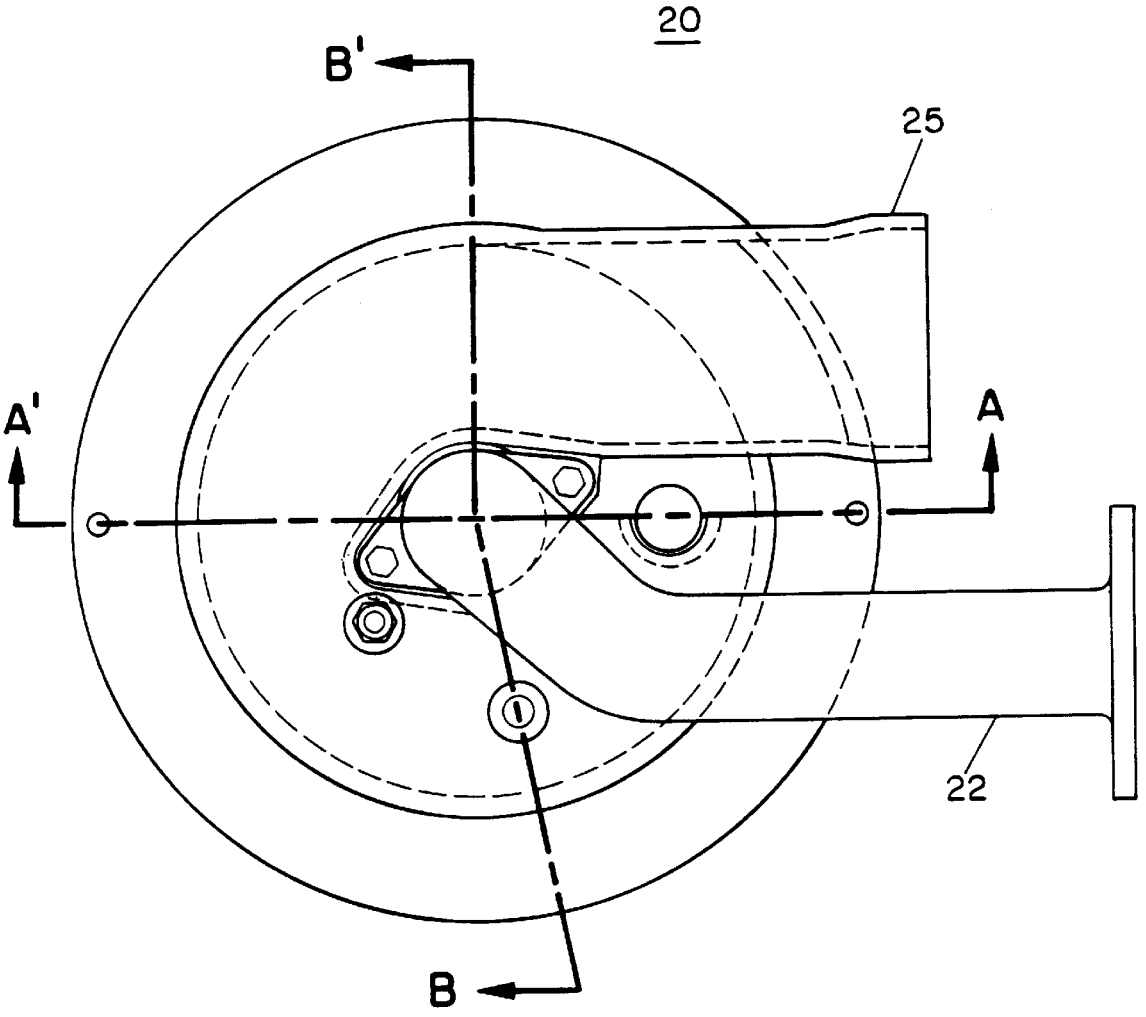
FIG. 4 is a top view of a burner of an embodiment of the present invention.
Figure 5:
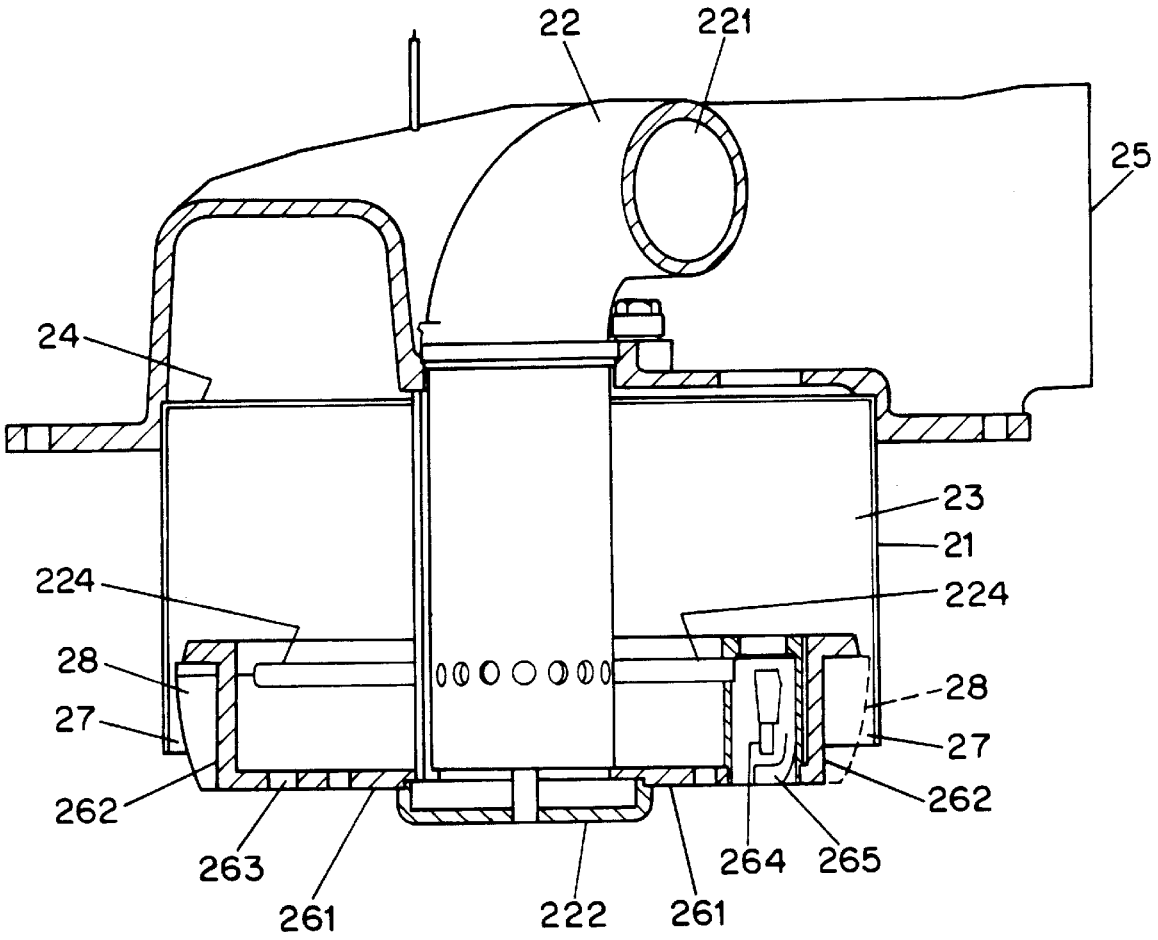
FIG. 5 is a sectional view of an embodiment of the present invention taken along line A—A' of FIG. 4.
Figure 6:
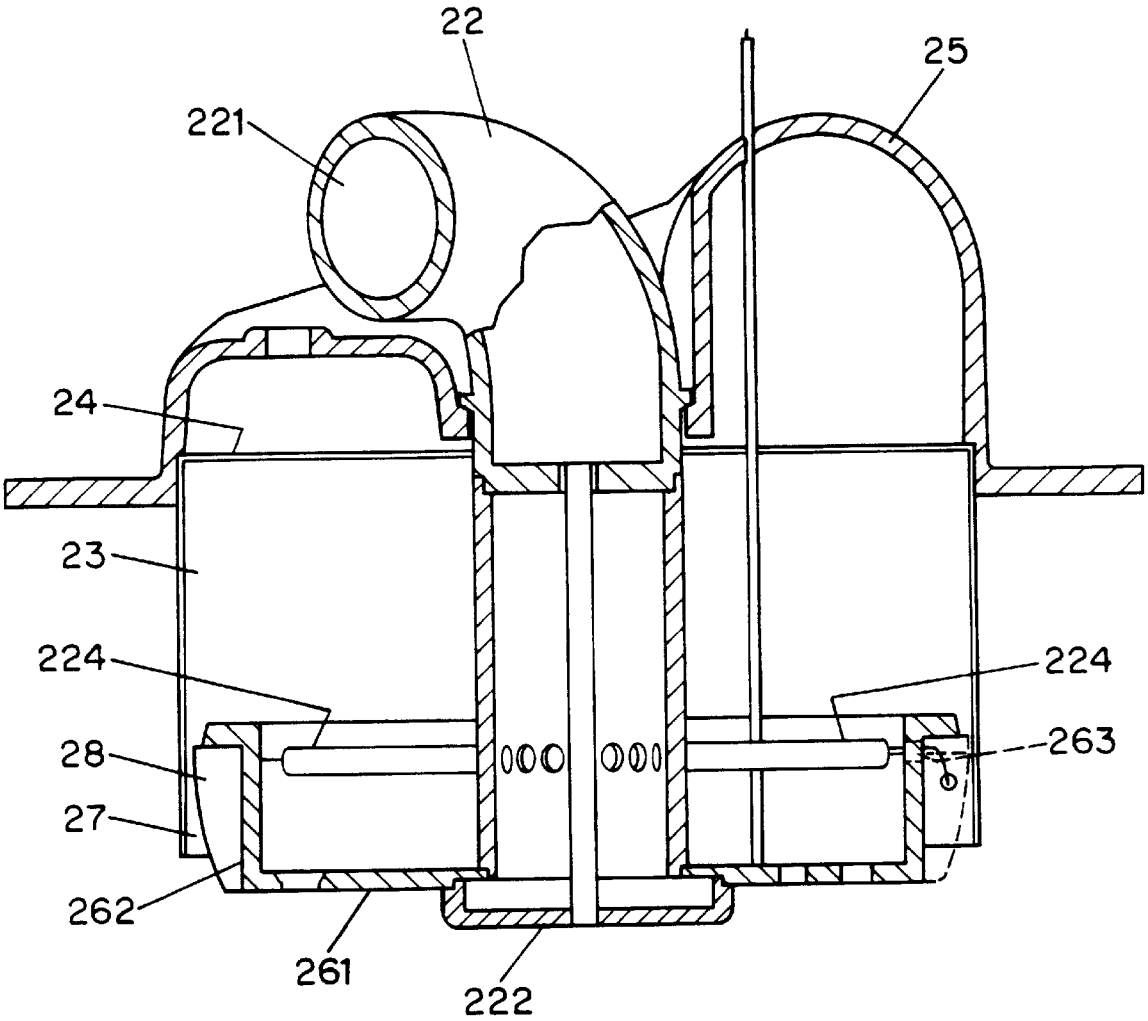
FIG. 6 is a sectional view of an embodiment of the present invention taken along line B—B' of FIG. 4.
Figure 7:
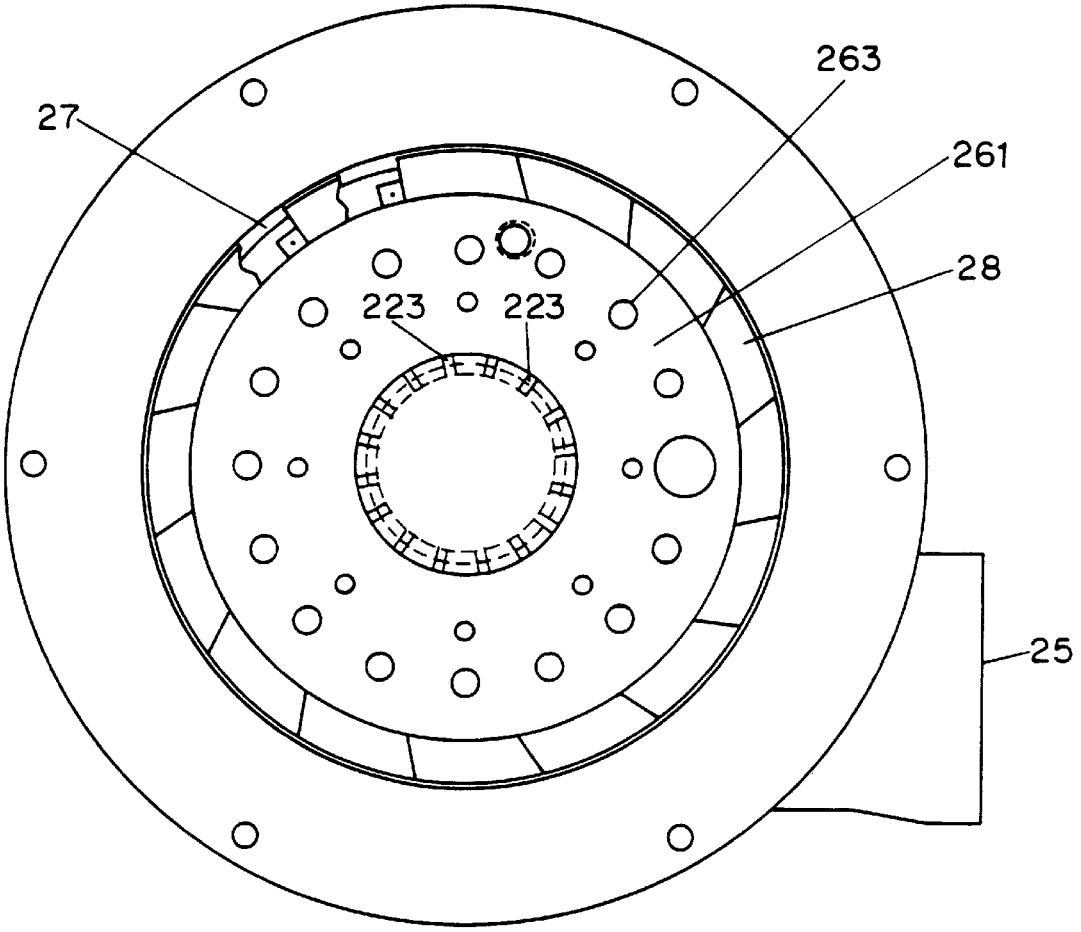
FIG. 7 is a bottom view of the burner of an embodiment of the present invention.

More specifically, referring to FIG. 2, the water chamber 12 preferably consists of a cylindrical lower shell 121 joined to a cylindrical upper shell 122 by an expansion joint 125 (which acts to absorb stresses due to thermal expansion of the shells). A backing ring 126 is preferably butt welded to the lower end of the expansion joint 125 for support of the shells. The lower shell 121 contains a water inlet nozzle 70, and the upper shell 122 contains a water outlet nozzle 72. The lower shell 121 contains a flange welded to the outer diameter of the shell to provide a means for attachment of a gas exhaust manifold 58.

The water chamber further consists of two tubesheets, a lower tubesheet 123 and an upper tubesheet 124. These tubesheets are flat disks having a plurality of holes in which the heat exchange tubes 16 fit. In addition, the upper tubesheet contains a circle of holes along its outer edge through which water may flow. The lower tubesheet and the upper tubesheet are welded at their periphery to the bottoms of the lower shell 121 and the upper shell 122, respectively. The heat exchange tubes 16 are welded between these two tubesheets.

The combustion chamber consists of a cylindrical shell 141 on which an expansion joint 142 is welded at the upper end. In addition, a backing ring 143 is butt welded to the expansion joint for support. The combustion chamber 14 fits within the upper shell 122 and is welded at its lower end to the upper tubesheet 124. Both the combustion chamber 14 and the upper shell 122 are welded at their upper ends to a flat annulus 128, referred to as the upper head.

In operation, water enters from the water inlet nozzle 70 and travels upwards through the chamber in the lower shell 121, coming into contact with the outsides of the heat exchange tubes 16 as it travels up. When the water reaches the upper tubesheet, it passes through the holes along the tubesheet's outer edge into the annular channel created by the upper shell 122 and the combustion chamber shell 141. From this annular channel, the water exits at the water outlet nozzle 72. As the water travels upwards, hot gases travel downward through the combustion chamber 14 and through the heat exchange tubes 16 in true counterflow to the water flow. The gases exit through the gas exhaust manifold 58.

Accordingly, the present invention allows water to travel in physical isolation from, but in heat exchange relation with, the hot gases passing through the combustion chamber and the heat exchange tubes. As the water flows upwards in true counterflow to the hot gases, heat is transferred to the water, causing a temperature gradient in the direction of the water flow. Conversely, as the gases flow downwards, they are cooled in traversing the heat exchange tubes.

The true counterflow movement of the water and gases in the present invention provides for excellent efficiency of operation. As the gases are cooled below their dew point, they condense, providing additional heat to the water through the energy release of condensation. Efficiency levels greater than 90 percent, not possible without the condensing operation, are thus achieved. Moreover, the condensing operation is advantageous because the movement of condensate droplets or film through the heat exchange tubes helps to sweep out any carbon particles that may accumulate in the tubes, thereby maintaining optimal heat transfer.

The modulation of the present invention over a broad range is also advantageous to the efficiency of its operation. Since the present invention modulates over a broad range, the onset of condensation occurs at varying positions along the length of the heat exchange tubes. Thus, any corrosion that occurs is distributed over the heat exchange tubes instead of accumulating in one area.

Preferably, to optimize operation of the heat exchanger, it is desirable to include a baffle 127 in the water chamber. The baffle is welded at the expansion joint 125 just below the upper tubesheet 124, and it serves as a flow diverter which optimizes water flow distribution in the heat exchanger. The baffle may be a flat, circular disk with a central opening or may be a disk with a central, downward indentation with openings at its edges.

In addition, to further optimize operation of the heat exchanger, it is preferred that the components of the heat exchanger meet the following specifications. First, the water chamber and combustion chamber shells should be constructed of ASME/ANSI SA-53 grade B carbon steel pipe. Second, the upper head should be constructed of SA-516 grade 70 carbon steel. Third, the water output nozzle should consist of a 4 inch 150 r.f.s.o. flange with couplings welded in for a water level switch, a temperature limit switch, and a pressure relief valve. Fourth, the tubesheets and the heat exchange tubes should be constructed of type 316L stainless steel. Fifth, a preferred number of tubes is 211. Finally, the tubes should have a spiral corrugation formed into them, which forces the flowing gases into a turbulent flow regime at a lower velocity than designs utilizing smooth tubes. Such a design makes for a more compact heat exchanger. The resultant lower gas pressure also lessens the need for auxiliary boosters and increases the range of applications for the system.

Above the combustion chamber and the upper shell is the burner 20, which efficiently ignites a combustible mixture of air and gas to provide the hot gases used to heat the water. As shown in detail in FIGS. 4 to 7, the burner 20 is preferably an inconel nozzle mix burner (as opposed to a pre-mix burner) having a cylindrical outer shell 21 enclosing a gas pipe 22 at its center. The space between the outer shell 21 and the gas pipe 22 defines an annular air channel 23. An annular baffle 24 with ports for the passage of air is located at the top of the air channel 23. Above this baffle 24 is situated a spiraling air duct 25, through which air enters. The bottom of the burner 20 is defined by a burner head assembly 26, which consists of a flat, annular disk 261 with a cylindrical wall 262 connected to its periphery. Both the annular disk 261 and the cylindrical wall 262 have ports 263 for the passage of gas and air. The burner head assembly 26 is connected to the upper head 128 of the heat exchanger using a mating gasket and bolts.

The diameter of the annular disk 261 and wall 262 of the burner head assembly is less than that of the outer shell 21. Thus, a secondary annular channel 27 is formed between the outer shell 21 and the burner head wall 262. This channel provides a second path for air to flow through (the first being through the ports 263 in the annular disk of the burner head assembly). Vanes 28 are preferably welded (but may be integrally cast) to the burner head wall 262 in the secondary annular channel 27. These vanes impart a high degree of swirl to the air and gas that pass through the secondary channel.

The gas pipe 22 contains an gas entry port 221 at its upper end and a gas cap 222 at its lower end. The gas cap 222 protrudes below the burner head annular disk 261 and has a plurality of primary gas ports 223. The primary gas ports 223 are situated perpendicularly to the ports 263 of the annular disk 261 so that the gas expelled from the primary gas ports 223 collides at right angles with the gas and air expelled from the ports 263 in the annular disk 261. Such a collision of gases produces a desired, stable burning at variable energy release rates avoiding combustion driven oscillation.

Above the annular disk 261, the gas pipe contains a plurality of gas tubes 224 extending radially out from the gas pipe towards the burner head wall 262. The radial tubes 224 are arranged in asymmetric relationship with the vanes 28. These tubes allow the mixture of gas with air in the burner head assembly above the annular disk 261 and in the secondary channel 27.

Ignition of the mixture of air and gas is accomplished by an igniter spark electrode 264 that is housed in the burner head assembly 26. As a mixture of air and gas flow through the burner head assembly, ignition of the mixture is accomplished instantaneously. The burner head assembly may also house a flame detection electrode 265 to provide a means for detecting the ignition of the air and gas mixture.

The complete operation of the burner will now be described. Air and gas from the air/fuel valve 40 enter the air duct 25 and gas entry port 221, respectively. The air proceeds along a centrifugal path through the spiral air duct 25 and passes through the annular baffle 24. After passing the baffle, the air enters the air channel 23 and then proceeds into the burner head assembly 26 or the secondary channel 27. At the same time, the gas entering the gas entry port 221 proceeds through the gas pipe 22 and exits through the radial tubes 224 or the primary gas ports 223. The gas exiting through the radial tubes 224 mixes with the air coming through the burner head assembly or proceeds through the ports in the burner head wall into the secondary channel 27. In the secondary channel, the gas mixes with the air passing through there, and the vanes assure the mixture is spun at a very high velocity. The gas and air mixture in the burner head assembly is ignited by the spark electrode, and it passes through the ports in the annular disk, there mixing and igniting with the gas from the primary gas ports and the air/gas mixture from the secondary channel. The hot gases then proceed downwards into the combustion chamber.

Preferably, to optimize the operation of the burner, it is desirable to cast the outer shell from aluminum and to provide a type 310 stainless steel band on the inside of the outer shell in the area of the secondary annular channel. It is also desirable to investment cast the burner head from type 303 stainless steel and to construct the vanes from stainless steel.

The air and gas flow to the burner is controlled by the air/fuel valve 40, shown in detail in FIGS. 9 and 10A to 10C. This valve comprises preferably a rotary valve having a gas flow inlet 42 connected to a gas flow outlet 43 and an air flow inlet 46 connected to an air flow outlet 47. Orifice plates between the paths of the air and gas flows provide area openings for each flow that allow for separate but relatively proportional flow to the burner 20 (specifically, to the air duct 25 and gas entry port 221). A valve shaft 45 connects the two orifice plates and provides for the rotation of the orifice plates. Preferably, the valve shaft rotation of the orifice plates provides for a change in area openings that is linearly responsive to a control signal from the temperature controller 30. Preferably, the flows of air and gas to the burner 20 are at a substantially constant ratio producing an air/fuel mixture in the burner with excess oxygen of 5 percent. This ratio has been found to produce the best mixture for combustion.

Figure 10A:
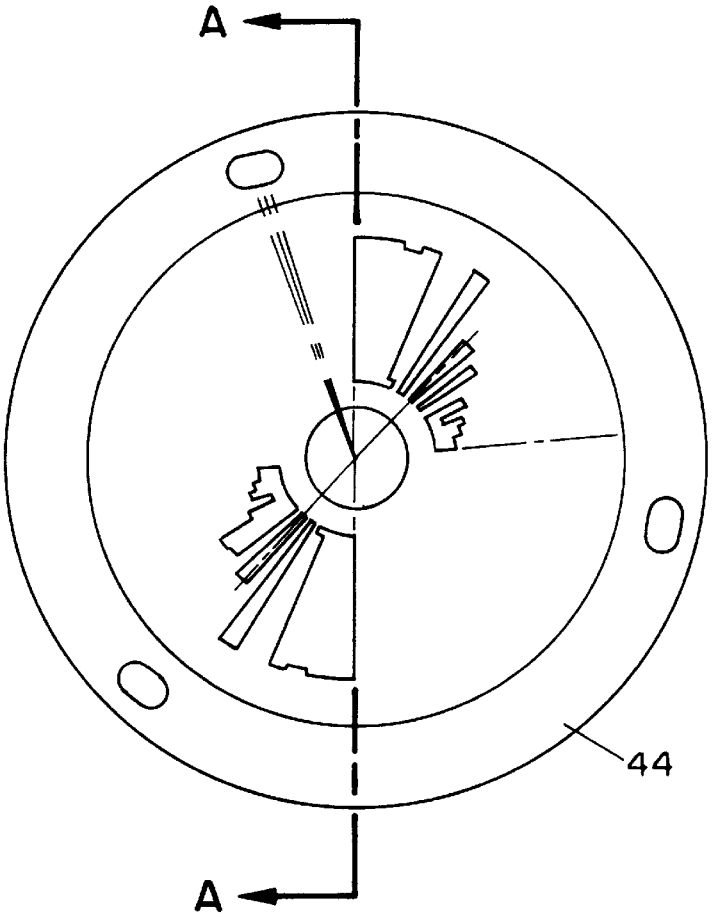
FIG. 10A is a top view of a gas orifice plate of an embodiment of the present invention.
Figure 10B:
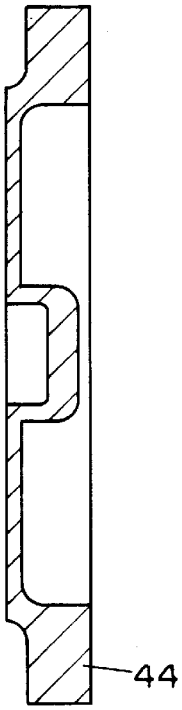
FIG. 10B is a sectional view of an embodiment of the present invention taken along line A—A' of FIG. 10A.
Figure 10C:
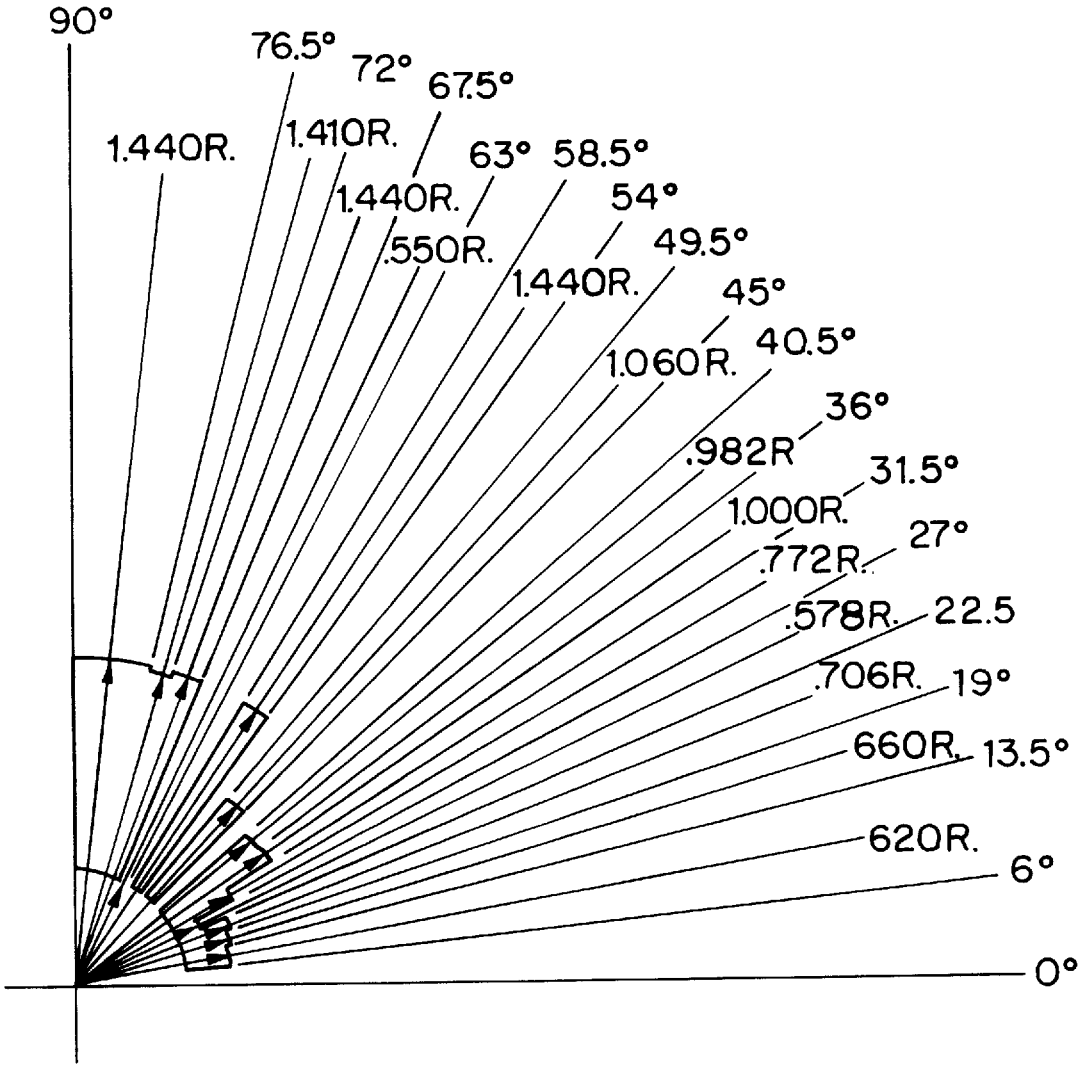
FIG. 10C is a graph of a gas orifice plate slot of an embodiment of the present invention.

A preferred embodiment of the orifice plate 44 for the gas flow path is shown in detail in FIGS. 10A to 10C. Unlike prior art orifice plates, which use slots of varying angular aperture and constant radial length, the present invention utilizes slots with varying angular aperture and varying radial lengths. Specifically, the present invention uses radial lengths that vary through the range of a slot's angular aperture. It has been found that varying radial lengths with rotational angle allows better matching of the gas flow to the air flow to achieve a desired air/fuel ratio.

As shown in the figures, as a result of manufacturing and spatial constraints, the radial lengths are usually varied in discrete rotational angles. In the figures, the radial lengths are varied in increments of 4.5 degrees. In addition, as shown, the inner radii of the slots are fixed while the outer radii of the slots are variable. It will appreciated by those skilled in the art, however, that the principle of the present invention would work just as well with other angular resolutions and variable inner radii.

Figure 8:
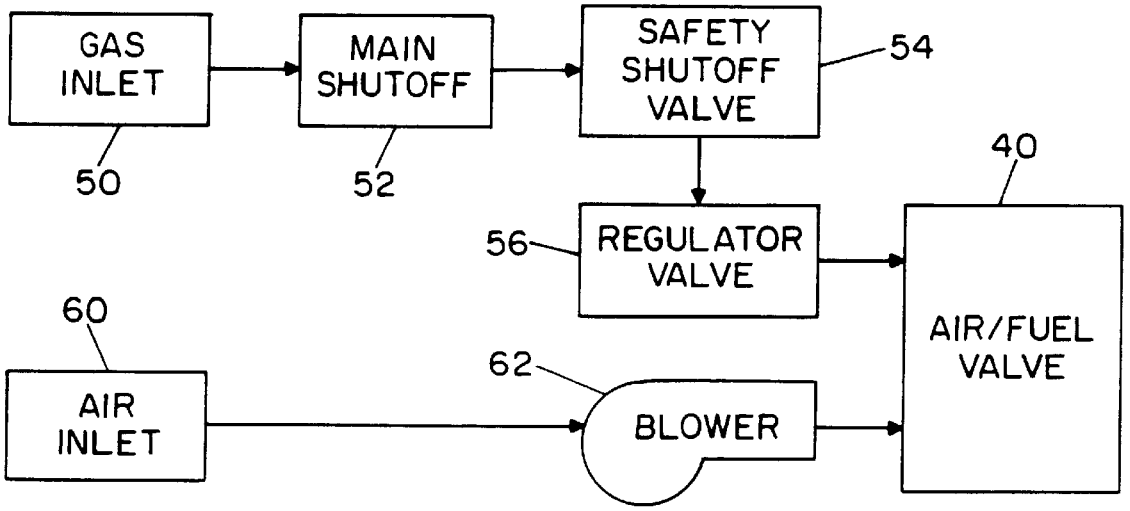
FIG. 8 is a block diagram of air and gas trains of an embodiment of the present invention.
Figure 9:
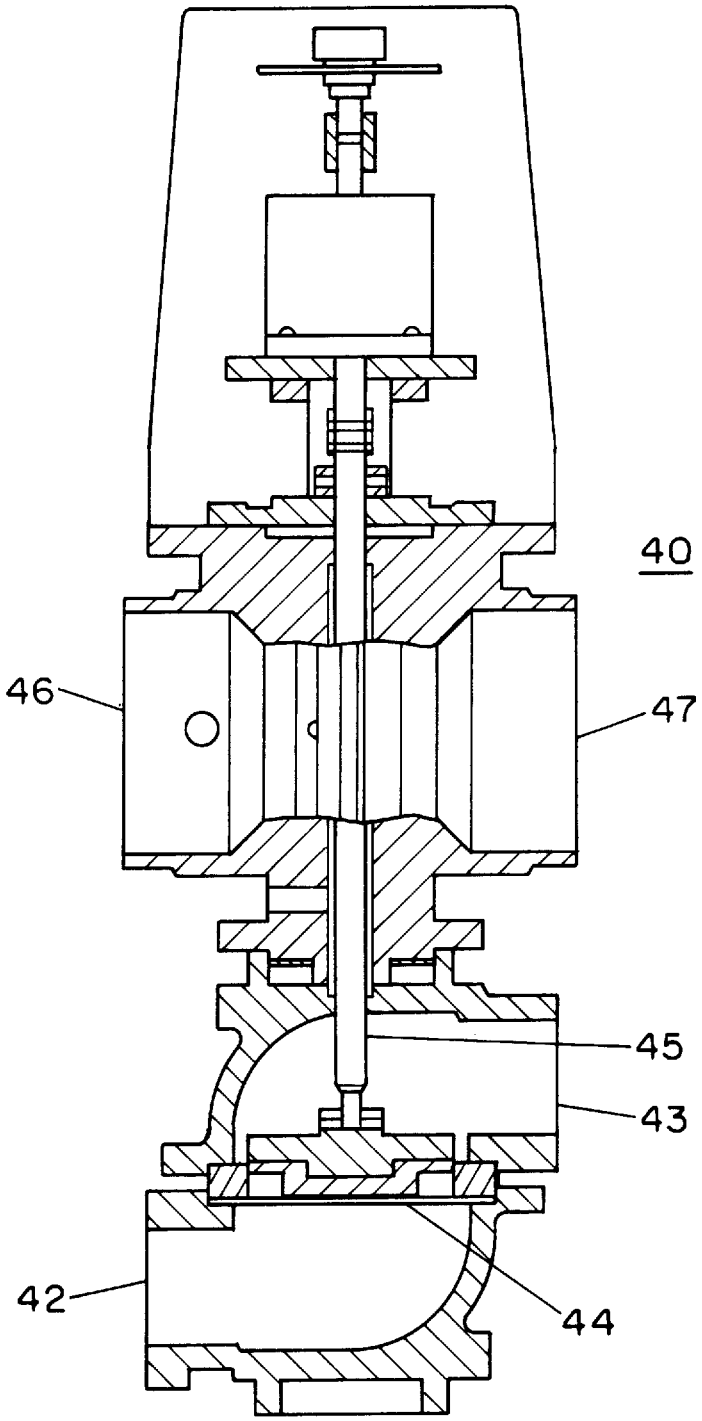
FIG. 9 is a side view of an air/fuel valve of an embodiment of the present invention.

The gas and air trains that lead to the air/fuel valve 40 are shown in FIG. 1 and are represented in diagram form in FIG. 8. As shown, the gas train includes a gas inlet 50 for incoming gas, a main shutoff valve 52 for manual shutoff of the gas flow for safety, a safety shut-off valve 54 for use by the temperature controller system 30 on start-up, and a regulator valve 56 for providing a constant pressure for the gas flow across the air/fuel valve 40. Preferably, the regulator valve is a differential pressure regulator. The air train includes an air inlet 60 leading to a blower 62, which accelerates the flow of air and provides a positive-pressure air flow to the air/fuel valve and burner.

The present invention also includes a temperature controller system 30 to control the operation of the air/fuel valve 40 and, thus, modulate the air/fuel mixture to the burner 20. The temperature controller system is responsible for the temperature regulation, safety monitoring, and diagnostic functions of the present invention. The temperature controller system used in the present invention may be a commercially available unit (for example, with the substitution of a 220 VAC motor starter for the one listed, the unit listed in UL Project No. 96NK5225).

Figure 11:
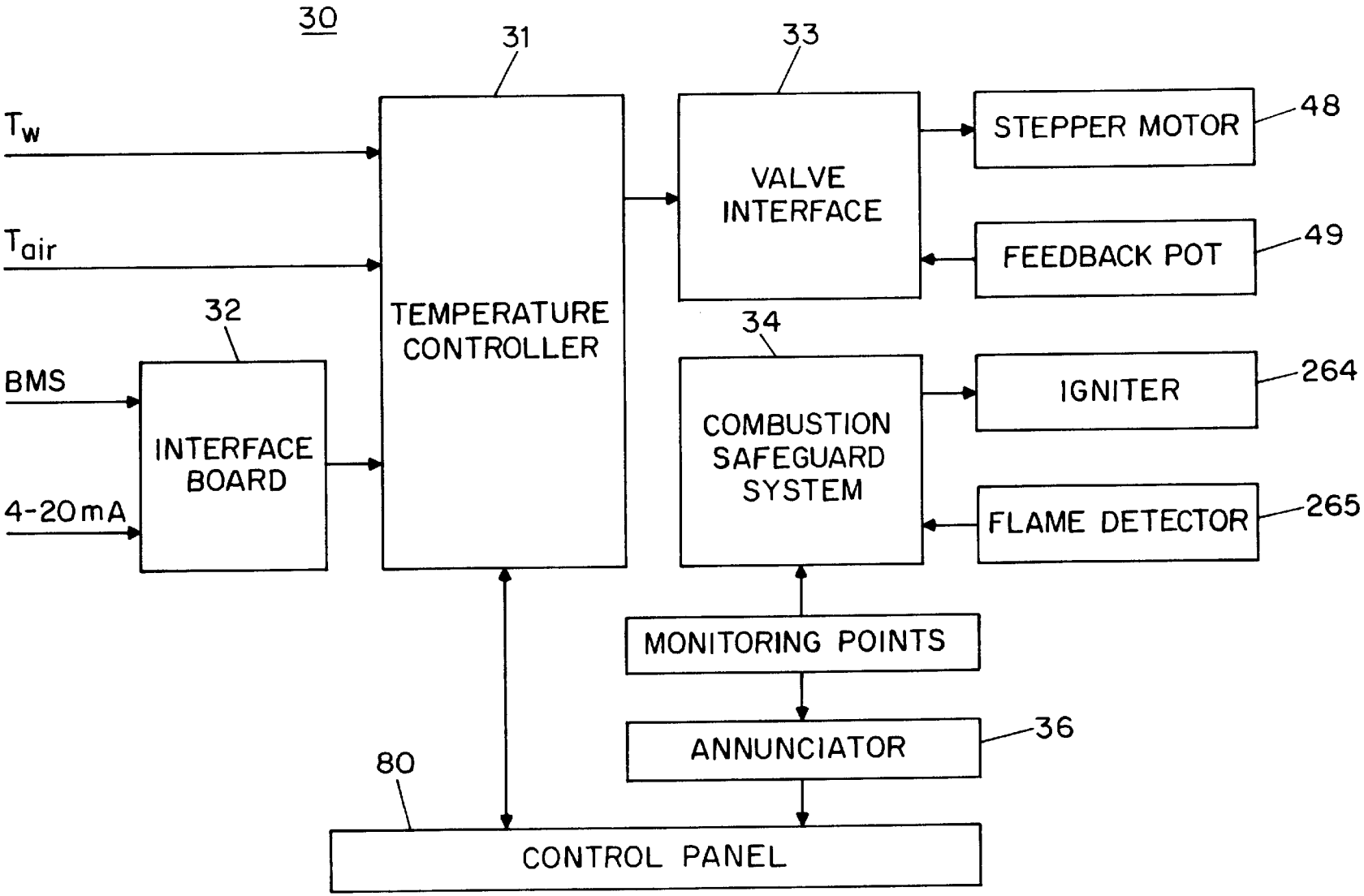
FIG. 11 is a block diagram of a temperature controller system of an embodiment of the present invention.

A functional block diagram of the operation of the temperature controller system is shown in FIG. 11. As shown, the main components of the temperature controller system are the temperature controller 31, the valve interface 33, the combustion safeguard system 34, and the annunciator 36.

The temperature controller 31 receives multiple inputs, which correspond to the different modes of operation of the temperature controller. Input Tw represents the temperature sensed from the hot, outgoing water; input Tair represents the temperature from an outdoor air sensor; input BMS represents a remote-control signal from a boiler management system; and input 4–20 ma is another remote-control input. These modes of operation may be selected through the control panel 80.

Once a mode of operation is selected, the temperature controller 31 calculates the rate of change of the temperature input and a value proportion to the difference between the temperature input and a set-point temperature. (The set-point temperature may be set through the control panel 80.) The temperature controller 31 sums these values together and uses their sum to send a control signal to the valve interface 33. In turn, the valve interface 33 controls a stepper motor 48, which rotates the valve shaft 45 of the air/fuel valve 40. A feedback potentiometer 49 provides feedback information to the valve interface on the rotational position of the stepper motor and valve shaft.

When the BMS or 4–20 ma mode of operation is chosen, the temperature controller may also receive the rate of firing directly from the remote controller at the user's option. In these modes, the temperature controller acts as a slave and does not perform any calculations.

The combustion safeguard system 34 is responsible for monitoring the safety of operation of the present invention. The combustion safeguard system monitors switches which are triggered when water temperature, water level, gas pressure, exhaust gas temperature, or air flow exceed their predetermined minimum or maximum limits.

The combustion safeguard system is also responsible for the timing of the start sequence, including the purge and ignition cycles. At start-up, the combustion safeguard system initiates a seven-second purge cycle, which purges any left-over combustibles from the unit. The combustion safeguard system energizes the blower 62 and shuts off the gas by closing safety shut-off valve 54. Next, the combustion safeguard system opens the air/fuel valve 40 fully and allows air to purge the system for seven seconds. Because of the known geometry of the air/flow valve and the known minimum air flow through the system (assuming the low air flow switch has not been tripped), the period of the purge cycle is sufficient to guarantee that any left-over combustibles are purged from the unit.

At the end of the purge cycle, the combustion safeguard system initiates an ignition cycle. The combustion safeguard system ignites the igniter spark electrode 264, rotates the air/fuel valve 40 to a low fire position, and opens the safety shut-off valve 54. The combustion safeguard system then checks for flame from the flame detection electrode 265. Once a flame is detected, the system waits a stabilization period of eight seconds. If, after the stabilization period, a flame is still detected, the unit is released to modulate. Again, because of the known geometry of the air/fuel valve, the stabilization period is sufficient to guarantee that the system is operating correctly.

The annunciator 36 monitors the same system signals as the combustion safeguard system 34. The annunciator provides diagnostic information on these signals to the control panel 80. The purpose of the annunciator is simply for diagnostic purposes. Unlike the combustion safeguard system, the annunciator plays no part in the actual operation of the system.

As described, the present invention has many advantages. First, as a result of the new heat exchanger design, the present invention has greatly improved efficiency over prior heating systems. For example, the present invention has 54 percent more heat transfer per square foot and twice the BTU per hour per cubic foot than the heating system disclosed in the '524 patent. Second, as a result of the corrugated tube design, the present invention operates at lower gas pressures than the prior smooth tube designs. Third, the reliability of the burner is improved over prior designs by the use of a spiral air duct, a recessed igniter, and a firing-down design. Lastly, as a result of placing the burner above the combustion chamber, the present invention avoids condensation in the burner.

The present invention also has a wide range of uses. For example, it will be readily obvious that the present invention can be used in hydronic boiler systems, low temperature water source heat pump systems, or any closed hot water systems. In addition, the present invention may be used by itself or in combination with other heat exchangers to provide domestic hot water. Alternatively, the present invention may be used in heating systems to supply space heating energy on a priority basis.

Although the present invention has been described with reference to certain preferred embodiments, other embodiments are possible. Therefore, the spirit and scope of the appended claims should not be limited to the preferred embodiments contained in this description.

I claim:

1. A heating device for providing heat transfer between a first fluid and a second fluid, comprising:

a combustion device for igniting a combustible mixture of air and gas to produce said first fluid;

a combustion chamber coupled to said combustion device and at least one exchange tube connected to said combustion chamber for receiving said first fluid;

an enclosure surrounding said at least one exchange tube for guiding said second fluid around said at least one exchange tube; and an air/fuel valve coupled to said combustion device for regulating said combustible mixture of air and gas, said air/fuel valve comprising a gas orifice plate having one or more slots, each slot having an angular aperture and a radial length that is variable throughout a range of the angular aperture.

2. A heating device for providing heat transfer between a first fluid and a second fluid, comprising:

a combustion device for igniting a combustible mixture of air and gas to produce said first fluid;

a combustion chamber coupled to said combustion device and at least one exchange tube connected to said combustion chamber for receiving said first fluid;

an enclosure surrounding said at least one exchange tube for guiding said second fluid around said at least one exchange tube; and a spiral air duct coupled to said combustion device.

3. The heating device of claim 2, further comprising a baffle positioned between said spiral air duct and said combustion device.

4. The heating device of claim 2, further comprising an air/fuel valve coupled to said combustion device for regulating said combustible mixture of air and gas.

5. The heating device of claim 1 or 4, further comprising a sensor for sensing the temperature of outgoing portions of said second fluid, and a controller coupled to said air/fuel valve and responsive to the sensed temperature from said sensor for controlling the rate of heat transfer between the first and second fluids by modulating the flow of air and gas through said air/fuel valve.

6. The heating device of claim 5, wherein said controller includes signal means for generating a signal derived from the sensed temperature, and air/fuel means responsive to said signal for modulating the flow of air and gas to said combustion means.

7. The heating device of claim 6, wherein said signal means includes derivative means for calculating the rate of temperature change of said second fluid, feedback means for subtracting the temperature of the outgoing portion of said second fluid from a set point predetermined temperature, and summation means for generating said signal based upon the summation of the values generated by said derivative means and feedback means.

8. The heating device of claim 6, wherein said air/fuel valve is a rotary valve that is linearly responsive to said signal to forward separate flows of air and gas to said combustion device at a substantially constant air/gas ratio maintained at a programmed relationship as a function of input gas flow.

9. The heating device of claim 8, wherein said gas flow is substantially linear with rotation of the air/fuel valve.

10. The heating device of claim 9, wherein said air/fuel valve includes an air inlet and gas inlet, and said substantially constant air/gas ratio produces excess oxygen of approximately 5%.

11. The heating device of claim 10, wherein said air/fuel means further includes a regulator valve for holding the pressure drop of the gas constant across said air/fuel valve such that a substantially linear flow of gas is established through the air/fuel valve.

12. The heating device of claim 11, wherein said air/fuel means further comprises:

gas inlet means for providing the incoming flow of gas;

a gas valve for selectively opening and closing the flow of gas;

air inlet means for providing the incoming flow of air;

blower means for accelerating the flow of air into said air inlet of the valve.

13. The heating device of claim 8, wherein said combustion device comprises a nozzle mix burner.

14. The heating device of claim 13, wherein said nozzle mix burner includes:

a gas pipe open at its top to receive gas from the air/fuel valve, and having a gas cap at its lower end, said cap having at least one gas port for the exit of gas; and a cylindrical air chamber enclosing said gas pipe having (a) an outer shell defining an air channel between said shell and said gas pipe means, (b) an annular baffle covering the top of said chamber having air entry means for receiving air from the air/flow valve, and (c) a burner head assembly positioned at the bottom of said chamber having primary exit means for providing an exit for air from the channel.

15. The heating device of claim 14, wherein the burner head assembly contains a flat, annular portion with a diameter less than the diameter of the outer shell and a cylindrical wall connected to the outer edge of the annular portion, wherein the gas pipe contains at least one gas tube extending radially outward from the gas pipe towards the outer shell, said at least one gas tube providing a conduit for the introduction of gas into an area just above the annular portion of the burner head assembly, wherein the cylindrical wall of the burner head assembly contains secondary exit means for the exit of gas and air, and the cylindrical wall of the burner head assembly and the outer shell of the air chamber form a secondary channel for the passage of gas and air.

16. The heating device of claim 15, wherein said nozzle mix burner further comprises spinner vanes formed in the secondary channel in asymmetric relation with said at least one gas tube, said spinner vanes adapted to spin the mixture of air and gas at a very high velocity at the lower end of the secondary channel.

17. The heating device of claim 1 or 2, wherein said enclosure comprises a water chamber having an inlet and outlet between which said second fluid passes, said water chamber enclosing the combustion chamber.

18. The heating device of claim 17, wherein a baffle is located in the water chamber below the combustion chamber, the baffle acting to divert and distribute the flow of the second fluid around the combustion chamber.

19. The heating device of claim 17, further comprising a plurality of exchange tubes connected to the bottom of the combustion chamber, the tubes extending below the combustion chamber and through the water chamber, such that the first fluid flows downward through the combustion chamber and then through the tubes in physical isolation from and in heat exchange relation with the second fluid, and the second fluid flows upwards through the water chamber, flowing about the tubes and then around the outside of the combustion chamber in counterflow to the first fluid's flow.

20. The heating device of claim 19, wherein the plurality of exchange tubes comprise substantially equally spaced apart exchange tubes each extending straight downwards from the bottom of the combustion chamber to the bottom of the water chamber.

21. The heating device of claim 20, wherein said fluids are at different temperatures such that a temperature gradient is established in the second fluid in the direction of its flow and that the first fluid is cooled in traversing, downwards through the tubes, the second fluid below the dew point of the first fluid causing the vapor in the first fluid to condense in the tubes.

22. The heating device of claim 19, wherein said tubes extend downwards from the combustion chamber without supporting baffles.

23. The heating device of claim 1 or 2, further comprising an exhaust stack coupled to an exhaust manifold, said exhaust manifold positioned below said at least one exchange tube for receiving the exhausted fluids from said at least one exchange tube and guiding said fluids through said exhaust stack into the atmosphere.

24. The heating device of claim 1 or 2, further including a combustion safeguard device including a sensor for sensing the temperature of the exhausted first fluid, and means responsive to said sensed exhaust temperature for providing a signal to the controller to provide an indication of flue temperatures above a predetermined limit.

25. The heating device of claim 1 or 2, wherein said first fluid is gas and said second fluid is water.

* * * * *

UNITED STATES PATENT AND TRADEMARK OFFICE

CERTIFICATE OF CORRECTION

PATENT NO. : 5,881,681

DATED : March 16, 1999

INVENTOR(S) : Kevin J. Stuart

It is certified that error appears in the above-identified patent and that said Letters Patent is hereby corrected as shown below:

Col. 6, line 26: "316L" should read --316L--.
Col. 6, line 27: "211." should read --211.--.
Col. 6, line 39: "inconel" should read --Inconel--.
Col. 7, line 44: "310" should read --310--.
Col. 7, line 47: "303" should read --303--.
Col. 7, line 65: "5" should read --5--.
Col. 8, line 39: "220" should read --220--.

Signed and Sealed this

Eighth Day of August, 2000

*Attest:*

Q. TODD DICKINSON

*Attesting Officer*

*Director of Patents and Trademarks*